US005399067A

United States Patent [19]

Yoshida

[11] Patent Number: 5,399,067

[45] Date of Patent: Mar. 21, 1995

[54] NOZZLE FOR USE IN A GEOTHERMAL STEAM TURBINE AND METHOD FOR PREVENTING ADHESION OF SCALE THERETO

[75] Inventor: Kouichi Yoshida, Nagasaki, Japan

[73] Assignee: Mitsubishi Jukogyo Kabushiki Kaisha, Tokyo, Japan

[21] Appl. No.: 225,000

[22] Filed: Apr. 6, 1994

Related U.S. Application Data

[63] Continuation of Ser. No. 858,950, Mar. 27, 1992, abandoned.

[30] Foreign Application Priority Data

Apr. 9, 1991 [JP] Japan ..... 3-031645 U

[51] Int. Cl.[6] ..... F01D 5/18

[52] U.S. Cl. ..... 415/115; 416/96 R; 60/641.2; 60/641.3

[58] Field of Search ..... 415/114, 115, 116, 1; 416/95, 96 R; 60/39.33, 39.75, 641.2, 641.3

[56] References Cited

U.S. PATENT DOCUMENTS

| | | | |
|---|---|---|---|
| 2,549,819 | 4/1951 | Kane | 415/116 |
| 2,857,133 | 10/1958 | Burke et al. | 415/116 |
| 2,977,090 | 3/1961 | McCarty et al. | 415/116 |
| 3,756,020 | 9/1973 | Moskowitz et al. | 415/114 |
| 4,183,456 | 1/1980 | Schilling et al. . | |
| 4,441,856 | 4/1984 | Tsujimura et al. | 415/184 |
| 4,492,517 | 1/1985 | Klompas | 415/115 |

FOREIGN PATENT DOCUMENTS

| | | | |
|---|---|---|---|
| 0058102 | 5/1979 | Japan | 60/641.2 |
| 0069214 | 4/1985 | Japan | 415/115 |
| 1-102401 | 7/1989 | Japan . | |
| 381851 | 11/1932 | United Kingdom . | |

*Primary Examiner*—Edward K. Look
*Assistant Examiner*—Christopher Verdier
*Attorney, Agent, or Firm*—Wenderoth, Lind & Ponack

[57] ABSTRACT

A nozzle for use in a geothermal steam turbine is adapted to prevent precipitation and adhesion of scale onto the surface of the nozzle. A coolant water passageway is provided in an initial stage nozzle of a geothermal steam turbine. An inlet side passageway of this coolant water passageway is communicated with coolant water inlet passageways provided in inner and outer turbine casings, respectively. Also, an outlet side passageway is communicated with coolant water outlet passageways. Due to this construction, coolant water is made to pass through the coolant water passageway within the nozzle from a coolant water feed source to lower the surface temperature of the nozzle, and thereby reevaporation and condensation of drain on the blade surface are prevented to prevent precipitation of scale.

7 Claims, 3 Drawing Sheets

NOZZLE FOR USE IN A GEOTHERMAL STEAM TURBINE AND METHOD FOR PREVENTING ADHESION OF SCALE THERETO

CROSS-REFERENCE TO RELATED APPLICATION

This application is a Continuation of U.S. application Ser. No. 07/858,950, filed Mar. 27, 1992, now abandoned.

BACKGROUND OF THE INVENTION

1. Field of the Invention

The present invention relates to a nozzle, especially a nozzle for use in a geothermal steam turbine, and more particularly to a nozzle for use in a geothermal steam turbine which is adapted to prevent precipitation and adhesion of scale onto a nozzle surface, and a method for preventing the adhesion of scale onto the nozzle.

2. Description of the Prior Art

The purity of steam in a geothermal power plant is a factor exerting a very large influence upon the reliability of the power plant. More particularly, $SiO_2$, Fe, Na, Cl and the like contained in steam have the tendency of precipitating and adhering as scale 4, mainly to a rear surface 2 and a concave front surface 3, of a first stage nozzle 1, as shown in FIG. 3. Adhesion of scale onto the first stage nozzle does not only bring about a lowering of the output power, caused by a reduction of the nozzle area, but also could possibly result in a breakdown or accident of the rotor (moving blades or a disc) due to contact between the scale and the rotor. Accordingly, the adhesion of scale onto a nozzle is a factor largely governing the overhaul interval of a geothermal power plant. From the above-mentioned reasons, establishment of a technique for preventing the adhesion of scale to a nozzle is an essentially necessary problem in view of both the aspects of insuring reliability of the geothermal power plant and improving the availability factor of the same.

On the other hand, one currently practiced technique for preventing adhesion of scale is a method illustrated in FIG. 4, which has been known. More particularly, this method is a method consisting of the steps of extracting a part of steam 13 fed to a geothermal steam turbine 12 through an inlet steam pipe 11 and condensing the part in a condenser 14, then injecting the thus condensed water 15 into the steam 13 flowing through the inlet steam pipe 11 by pressurizing it with a pump 16, and thereby water-washing out the scale adhering to the nozzle within the turbine 12. It is to be noted that reference numerals 17 and 18 designate valves.

As described above, the method known in the prior art is a method of water-washing scale adhered to a nozzle by injecting condensed water 15 prepared from geothermal steam into the inlet steam pipe 11 of the geothermal steam turbine 12. This method is generally called the "water-washing method". However, according to practical results in a practically used machine, there are some plants in which this method is not always effectively practiced.

Considering the reasons of the unavailability of a method for prevention precipitation in the prior art, it appears that attention was paid solely to removal of the precipitated and adhered scale, and a fundamental countermeasure for removing the cause was not taken. Therefore, the inventors of the present invention at first investigated the mechanism of "adhesion of scale". The results of an examination of a composition of moisture mixed in the steam of the investigated geothermal power plant were:

| | | |
|---|---|---|
| Na | 0.2 ppm | as NaCl . . . 0.55 ppm |
| Cl | 0.35 ppm | |
| $SiO_2$ | 0.066 ppm | |

It was further investigated, with respect to a rear surface and a concave front surface of the nozzle, how these components adhere to the nozzle surfaces. The results were as follows:

<Rear Surface of Nozzle>

As shown in FIG. 5(A), at the portion downstream of Point , which is about 0.55 (width) apart from the front edge of the nozzle, the metal surface temperature is higher than the steam temperature at the blade surface. Consequently, drain would reevaporate from the metal (blade) surface, and NaCl and $SiO_2$ would condense and would be precipitated as scale.

However, it is to be noted that, whereas a percentage content of NaCl is 0.55 ppm, that of $SiO_2$ is as small as 0.066 ppm, and moreover, since $SiO_2$ is liable to transfer to the vapor phase in view of the distribution rate which is characteristic to $SiO_2$ and is liable to disperse into the steam flow, the principal component of the scale is NaCl.

From the above-mentioned reasons, the following conclusion is obtained:

(1) Scale would precipitate on the downstream side of the position about 0.55 (width) apart from the front edge.

(2) A principal component of the scale is NaCl.

<Front Surface of Nozzle>

As shown in FIG. 5(B), since a metal (blade) surface temperature is lower than a steam temperature at the surface of the blade in nearly all the range, condensation of steam into drain would proceed on the surface of the blade, but reevaporation of the drain would not occur. Since the solubility of NaCl is large, if drain is present, NaCl would not precipitate as scale. Accordingly, on the front (concave) surface of the nozzle where, reevaporation of drain would not occur, NaCl could never precipitate as scale. On the other hand, with respect to $SiO_2$, at the location behind the Point (the position about 0.95 (width) apart from the front edge) where condensation of drain commences gradually, it precipitates as scale by the amount exceeding its solubility.

From the above-mentioned reasons, the following conclusion is obtained:

(1) Scale would precipitate in the proximity of the rear edge.

(2) A principal component of the scale is $SiO_2$.

Further, with respect to Fe, it precipitates at the location where drain condensates.

SUMMARY OF THE INVENTION

The present invention has been worked out in order to resolve the problems in the prior art, and has the object of providing a nozzle having a structure for directly preventing precipitation of scale in which precipitation and adhesion of scale onto a nozzle are themselves prevented without relying upon a method of removing scale adhered to the nozzle.

In order to resolve the above-mentioned problems, in a nozzle for use in a geothermal steam turbine according to the present invention, a coolant water passageway for cooling the surface of the nozzle has been formed on the inside of the nozzle.

Also, for the purpose of effectively carrying out cooling of the nozzle surface, an inlet side of the above-mentioned coolant water passageway has been disposed on the upstream side of the width of the nozzle. The bore diameter of the above-mentioned coolant water passageway has been chosen to be nearly $\frac{1}{3}$ of the nozzle thickness, and the above-mentioned coolant water passageway has been connected to a coolant water feed source via a coolant water passageway formed in a turbine casing.

In addition, in the method for preventing the adhesion of scale to a nozzle for use in a geothermal steam turbine according to the present invention, provision has been made such that the coolant water may be made to pass through the inside of the nozzle to make the nozzle surface temperature lower than the steam temperature at the nozzle surface, and thereby precipitation of scale onto the nozzle surface may be prevented.

Precipitation and adhesion of NaCl onto the rear surface of a nozzle would occur due to the fact that drain on the blade surface reevaporates. Precipitation and adhesion of $SiO_2$ onto the concave front surface would occur due to the fact that drain is condensed in the proximity of the rear edge of the blade, and its concentration exceeds the solubility of $SiO_2$.

Accordingly, if this reevaporation and condensation of the drain are prevented, then precipitation and adhesion of NaCl and $SiO_2$ could be prevented. To that end, the surface temperature of the nozzle is lowered by externally leading coolant water into the coolant water passageway provided within the nozzle, and thereby reevaporation and condensation of drain onto the blade surface can be prevented and precipitation of scale itself can be prevented.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
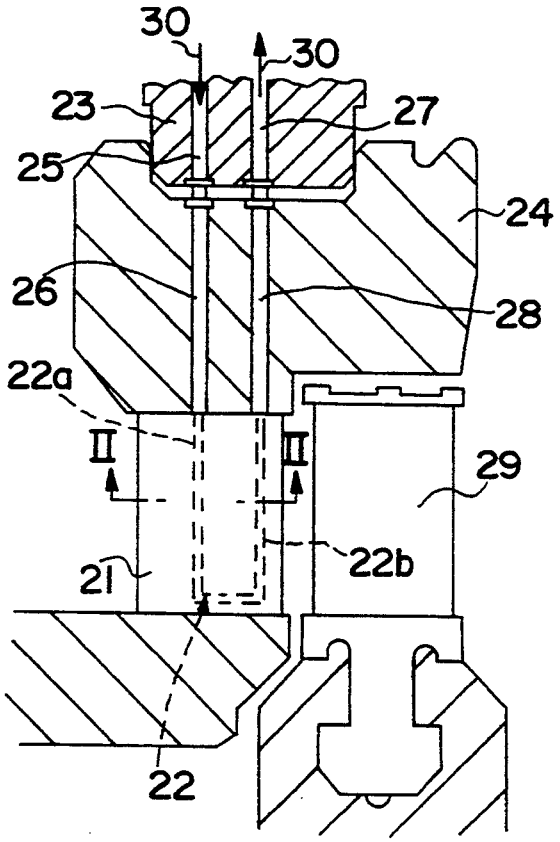
FIG. 1 is a cross-sectional view of an initial stage portion of a geothermal steam turbine making use of a nozzle according to one preferred embodiment of the present invention.
Figure 2:
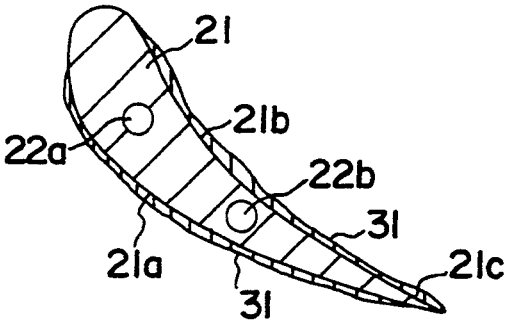
FIG. 2 is a cross-sectional view taken along line II—II in FIG. 1.
Figure 3:
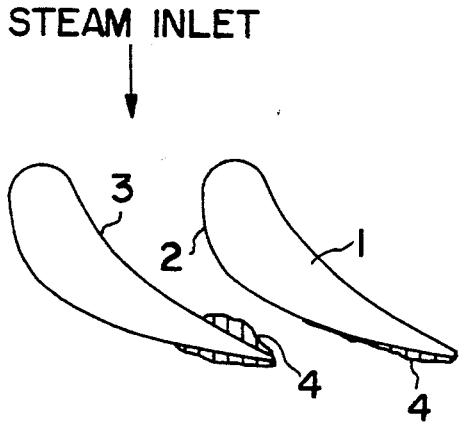
FIG.3 PRIOR ART
FIG. 3 is a schematic view showing a state of adhesion of scale onto a nozzle in the prior art.
Figure 4:
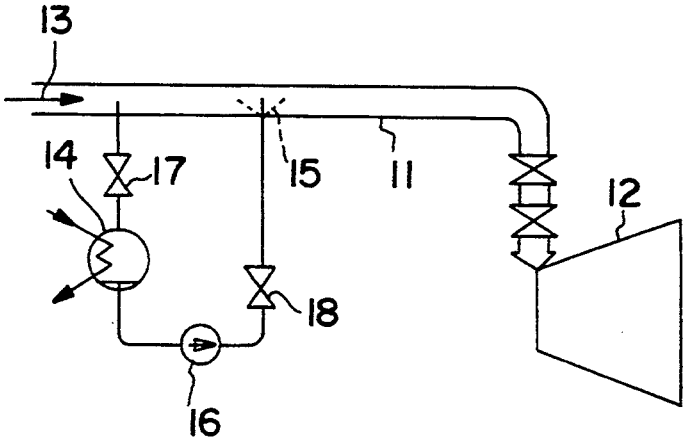
FIG.4 PRIOR ART
FIG. 4 is a system diagram showing a method for removing scale in the prior art.

In the following, detailed description will be made of one preferred embodiment of the present invention with reference to FIGS. 1 and 2. FIG. 1 is a cross-sectional view of an initial stage portion of a geothermal steam turbine making use of a nozzle according to one preferred embodiment of the present invention, and FIG. 2 is a cross-section sectional view taken along line II—II in FIG. 1.

In these figures, reference numeral 21 designates an initial stage nozzle. Within this nozzle 21 is formed a closed loop coolant water passageway 22. An inlet side coolant water passageway 22*a* of this coolant water passageway 22 is communicated with coolant water inlet passageways 25 and 26 formed, respectively, in an outer turbine casing 23 and in an inner turbine casing 24. Likewise, an outlet side coolant water passageway 22*b* of the coolant water passageway 22 is communicated with coolant water outlet passageways 27 and 28 formed, respectively, in the outer turbine casing 23 and in the inner turbine casing 24. It is to be noted that in FIG. 1, reference numeral 29 designates a moving blade stage.

In the above-described construction, the metal surface temperature of the nozzle 21 is lowered by making coolant water 30 flow through the coolant water passageway 22 (22*a*, 22*b*) provided within the nozzle 21 from an external coolant water feed source (not shown) through the coolant water inlet passageways 25 and 26 and the coolant water outlet passageways 27 and 28 provided in the inner and outer turbine casings 23 and 24, respectively. Thereby drain 31 on the surface of the nozzle 21 can be prevented from reevaporating or condensing, as shown in FIG. 2.

Describing this in more detail, generally, on a rear surface 21*a* of the nozzle 21, on the downstream side of the nozzle surface, since the metal temperature is higher than the steam temperature at the nozzle surface, NaCl and the like would precipitate and adhere to the nozzle surface due to the fact that drain produced by condensation of steam on the inlet side of the nozzle would reevaporate.

Whereas on the concave front surface 21*b* of the nozzle 21, on the downstream side of the nozzle surface, since the metal temperature is lower than the steam temperature at the nozzle surface, condensation into drain of the steam on the nozzle surface would proceed, but in the proximity of the rear edge 21*c*, the metal temperature becomes higher than the steam temperature at the nozzle surface, and condensation of the drain proceeds. As a result, impurities such as $SiO_2$ and the like would reveal the tendency of precipitation and adhesion by an amount exceeding their solubilities.

Accordingly, by lowering the metal surface temperature by cooling the nozzle as per the present invention, reevaporation and condensation of drain on the nozzle surface can be prevented, and thereby precipitation and adhesion of scale itself can be prevented. It has been confirmed through demonstration tests that, whereas in the conventional nozzle such a large amount of scale adheres to the nozzle within a short period of time that a throat portion of the nozzle is blocked, in the nozzle according to the present invention, scale does almost not adhere to the nozzle, and thus cooling of the nozzle is very effective as a countermeasure for preventing adhesion of scale.

Figure 5A:
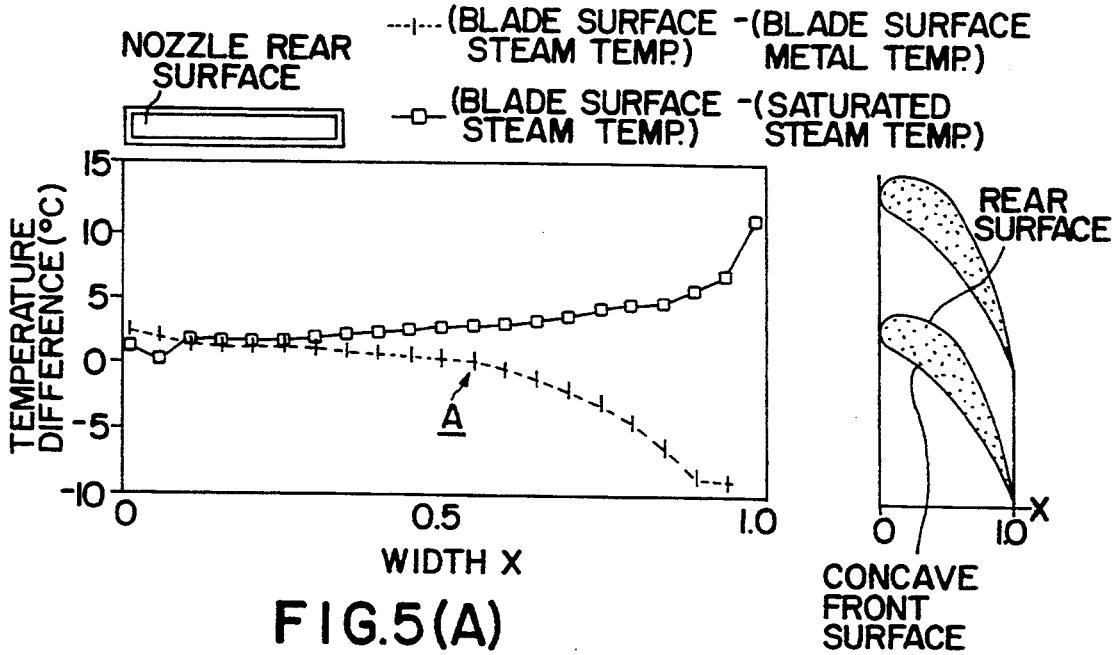
FIGS. 5(A) and (B) are diagrams showing temperature difference distributions on nozzle blade surfaces.
Figure 5B:
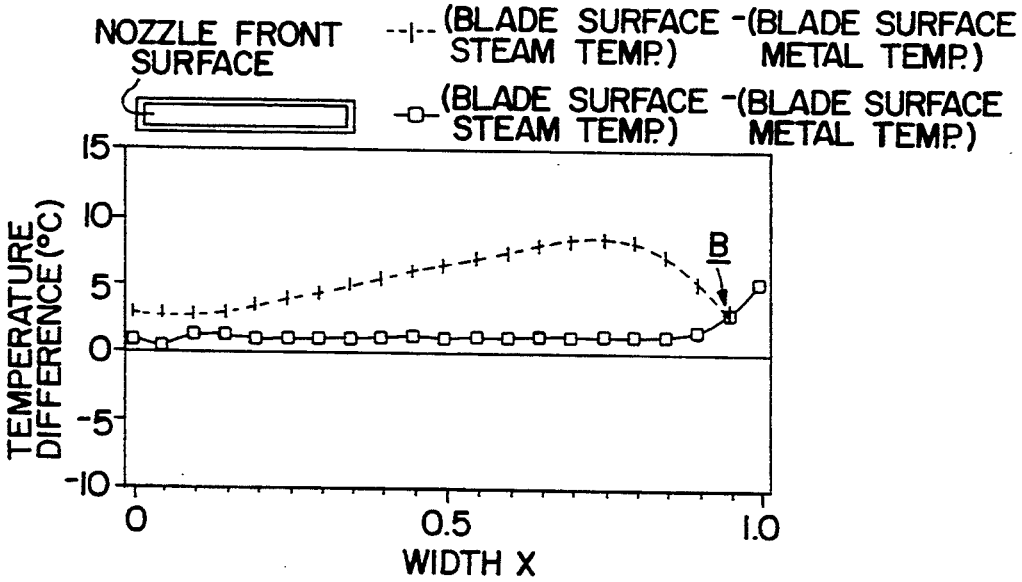

It is to be noted that preferably in, order to fully reveal the effect of preventing adhesion of scale, it is desirable that with respect to the coolant water passageway 22 to be provided within the nozzle 21, the inlet side coolant water passageway 22*a* and the outlet side coolant water passageway 23*b* thereof should be disposed at the central portion of the blade thickness (on the mean camber line). Also, the inlet side coolant water passageway 22*a* should be disposed on the upstream side by 50% or more of the blade width in view of the relation of the metal (blade) surface temperature versus the blade surface steam temperature shown in FIG. 5(A), and the bore diameter of the coolant water passageway is chosen to be about $\frac{1}{3}$ of the blade thickness.

As described in detail above, according to the present invention, by lowering the surface temperature of a nozzle by externally making coolant water pass through a coolant water passageway provided within the nozzle, reevaporation and condensation of drain on a blade surface can be prevented, and thus precipitation of scale can be prevented and scale will never adhere to the nozzle. The present invention thereby offers the advantages both that lowering of an output power caused by reduction of a nozzle area and damage to the rotor caused by contact between scale and the rotor can be prevented.

While a principle of the present invention has been described above in connection with one preferred embodiment of the present invention, it is a matter of course that many apparently widely different embodiments of the present invention could be made without departing from the spirit of the present invention.

What is claimed is:

1. A geothermal steam turbine, comprising:

a nozzle stage having a plurality of nozzles annularly arranged, said nozzle stage having an upstream side for receiving geothermal steam and a downstream side;

a moving blade stage disposed downstream of said nozzle stage for receiving the geothermal steam from said downstream side of said plurality of nozzles for turning said moving blade stage; and means for preventing the deposition of scale from the geothermal steam on said plurality of nozzles of said nozzle stage by cooling said nozzles to a surface temperature below the temperature of the geothermal steam at the surface of said nozzles, said means for preventing comprising a coolant water passageway in each of said plurality of nozzles cooling the surface of said nozzle;

wherein said coolant water passageway is a closed loop in each said nozzle, with the exception of an inlet and an outlet located at one end of said nozzle, said inlet being disposed upstream of said outlet, and said nozzle stage further comprising an inner turbine casing in which said plurality of nozzles are disposed and an outer turbine casing surrounding said inner turbine casing, said inlet and said outlet being connected to additional coolant water passageways in said inner and outer turbine casings for supply and removal of coolant water.

2. The geothermal steam turbine of claim 1, wherein said coolant water passageway comprises an inlet side coolant water passageway and an outlet side coolant water passageway, said inlet side coolant water passageway being located closer to said upstream side in said nozzle than said outlet side coolant water passageway.

3. The geothermal steam turbine of claim 1, wherein said coolant water passageway has a bore diameter about $\frac{1}{3}$ of the thickness of said nozzle.

4. The geothermal steam turbine of claim 1, wherein each said coolant water passageway is connected to a coolant water feed source through said additional coolant water passageways in said inner and outer turbine casings.

5. A method of preventing the adhesion of scale on nozzles of a geothermal steam turbine, said geothermal steam turbine having a nozzle stage with said nozzles annularly arranged and a moving blade stage disposed downstream of said nozzle stage, said method comprising the steps of, while geothermal steam passes through said nozzles of said nozzle stage, passing coolant water through the inside of said nozzles and lowering the temperature of the surface of said nozzles below the temperature of the steam at the surface of said nozzles, wherein said coolant water is passed into an inlet and out of an outlet in each said nozzle, a closed loop coolant water passageway extending between said inlet and outlet.

6. The method of claim 5, wherein said coolant water passes into said nozzles upstream of where said coolant water passes out of said nozzles.

7. A method of preventing the adhesion of scale on nozzles of a geothermal steam turbine, said geothermal steam turbine having a nozzle stage with said nozzles annularly disposed in an inner turbine casing, an outer turbine casing surrounding said inner turbine casing and a moving blade stage disposed downstream of said nozzle stage, said method comprising the steps of, while geothermal steam passes through said nozzles of said nozzle stage, passing coolant water through coolant water passageways in said nozzles, wherein said coolant water passageways are a closed loop in each said nozzle, with the exception of an inlet through which coolant water is received and an outlet through which coolant water is discharged at one end of said nozzle, said inlet being disposed upstream of said outlet relative to the direction of flow of geothermal steam through said nozzle stage, said coolant water passing to said inlet, and from said outlet, through additional coolant water passageways in said inner and outer turbine casings, and lowering the temperature of the surface of said nozzles below the temperature of the steam at the surface of said nozzles.

* * * * *